US010815730B2

(12) United States Patent
Liu et al.

(10) Patent No.: US 10,815,730 B2
(45) Date of Patent: Oct. 27, 2020

(54) ANTI-ROTATING DEVICE OF NON-ROTATING SLEEVE AND A ROTARY GUIDING DEVICE

(71) Applicant: Institute of Geology and Geophysics, Chinese Academy of Sciences, Beijing (CN)

(72) Inventors: Qingbo Liu, Beijing (CN); Qingyun Di, Beijing (CN); Tsili Wang, Beijing (CN); Wenxuan Chen, Beijing (CN); Jiansheng Du, Beijing (CN); Yongyou Yang, Beijing (CN); Xinzhen He, Beijing (CN); Linfeng Hong, Beijing (CN); Qijun Xie, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 16/348,022

(22) PCT Filed: Mar. 2, 2018

(86) PCT No.: PCT/CN2018/000083
§ 371 (c)(1),
(2) Date: May 7, 2019

(87) PCT Pub. No.: WO2019/095524
PCT Pub. Date: May 23, 2019

(65) Prior Publication Data
US 2020/0263500 A1 Aug. 20, 2020

(30) Foreign Application Priority Data
Nov. 14, 2017 (CN) ..... 2017 1 1119997

(51) Int. Cl.
*E21B 7/06* (2006.01)
*E21B 17/10* (2006.01)

(52) U.S. Cl.
CPC ..... *E21B 7/062* (2013.01); *E21B 17/10* (2013.01); *E21B 17/1014* (2013.01); *E21B 17/1021* (2013.01); *E21B 17/1078* (2013.01)

(58) Field of Classification Search
CPC .. E21B 17/10; E21B 17/1014; E21B 17/1021; E21B 17/1078; E21B 7/062
See application file for complete search history.

(56) References Cited

U.S. PATENT DOCUMENTS 3,126,065 A * 3/1964 Chadderdon ..... E21B 10/322 175/269
4,811,785 A * 3/1989 Weber ..... E21B 23/01 166/117.7
2014/0034317 A1* 2/2014 Hekelaar ..... E21B 29/005 166/298

FOREIGN PATENT DOCUMENTS

CN 101074596 A 11/2007
CN 101435314 A 5/2009
(Continued)

*Primary Examiner* — Tara Schimpf
(74) *Attorney, Agent, or Firm* — Birch, Stewart, Kolasch & Birch, LLP

(57) ABSTRACT

The invention discloses an anti-rotating device of non-rotating sleeve. The anti-rotating device is connected with the non-rotating sleeve in such way so that the anti-rotating device can transmit circumferential acting force to the non-rotating sleeve, thus the non-rotating sleeve are prevented from rotating, the anti-rotating device comprises an anti-rotating member and a resilient member, the anti-rotating member can move in a generally radial direction of the non-rotating sleeve, and the resilient member acts on the anti-rotating member and provides acting force being substantially radially outward for the anti-rotating member.
(Continued)

According to the anti-rotating device of the non-rotating sleeve and a rotary guiding device, on the one hand, bases can be provided for accurate attitude measurement and guiding control, on the other hand, excessively rapid rotation of the two non-rotating sleeve can be prevented only by using one anti-rotating device, and meanwhile the anti-rotating device can further provide guiding driving force based on the minimum structure size.

11 Claims, 4 Drawing Sheets

(56) References Cited

FOREIGN PATENT DOCUMENTS

| | | | |
|---|---|---|---|
| CN | 201347725 | Y | 11/2009 |
| CN | 103527083 | A | 1/2014 |
| CN | 106639913 | A | 5/2017 |
| CN | 107060643 | A | 8/2017 |
| WO | WO 2017/188935 | A1 | 11/2017 |

* cited by examiner

ANTI-ROTATING DEVICE OF NON-ROTATING SLEEVE AND A ROTARY GUIDING DEVICE

TECHNICAL FIELD

The invention relates to the field of drilling, and more particularly to the field of rotary guidance for controlling drilling guidance.

BACKGROUND TECHNOLOGY

In order to obtain natural resources storaged underground, drilling exploration is required. In many cases, the wellbore and the derrick are not aligned, but need to form a certain offset or bend. This process of forming horizontal or vertical offsets or other types of complex holes is called directional drilling. In the process of directional drilling, the direction control of the drill bit is called guidance. Modern directional drilling has two types: sliding guidance and rotary guidance. The drill string does not rotate when sliding guiding drilling; the bottom hole power drill (turbine drill, screw drill) drives the drill bit to rotate. The screw drilling tool and part of the drill string and the centralizer can only slide up and down against the well wall. Its shortcomings are large friction, effective weight-on-bit, low torque and power, low drilling rate, the wellbore spiralled and unsmooth and unclean, poor quality, easy to accident, and often forced to start the drill disc with "composite drilling", and "composite drilling" is often limited to use. The limit depth of sliding guidance is less than 4000 m.In order to change the orientation of the hole, it is necessary to change the structure of the drill string. Rotary steerable drilling system is the rotary drive of the drill string, the drill string and the rotary guiding tool are rolled on the well wall, and the rolling friction resistance is small. The rotary steerable drilling system can control and adjust its slanting and orienting function during drilling, and can complete the slanting, increasing the slope, stabilizing the slope and descending the slope along with the drilling process, and the friction is small, the torque is small, the drilling speed is high, larger drill bit penetration, the aging is high, the cost is low, and the well shaft is easy to control. With a limit of 15 km, it is a new type of weapon for drilling complex structural wells and offshore oil systems and super-large displacement wells (10 km).

The U.S. patent application US20140209389A1 discloses a rotary guiding tool, which comprises a non-rotating sleeve, a rotating shaft comprising a deflectable unit, the deflection unit being deflected by controlling the circumferential position of the eccentric bushing, thereby adjusting the drilling direction of the drill bit. During the entire guiding process, the control system needs to continuously measure the attitude of the non-rotating sleeve (the attitude measuring system and the control unit are generally installed in the non-rotating sleeve), and output control commands according to the attitude parameters. However, during the operation of the drilling system, the non-rotating sleeve will rotate with the drilling system due to inertia and non-negligible friction. Although the rotation speed of the non-rotating sleeve is lower than the driving shaft, the rotating non-rotating sleeve will still brings trouble to the attitude measurement, which makes the measurement accuracy difficult to guarantee, which in turn affects the control precision of the control system and affects the entire guiding operation.

Therefore, the prior art requires a technique that effectively blocks the rotation of the non-rotating sleeve with the combination of the drill, thereby providing a basis for accurate attitude measurement and steering control.

SUMMARY OF THE INVENTION

In order to solve the above problems, the invention proposes an anti-rotating device of non-rotating sleeve: the anti-rotating device is connected with the non-rotating sleeve in such way so that the anti-rotating device can transmit circumferential acting force to the non-rotating sleeve, thus the non-rotating sleeve are prevented from rotating, the anti-rotating device comprises an anti-rotating member and a resilient member, the anti-rotating member can move in a generally radial direction of the non-rotating sleeve, and the resilient member acts on the anti-rotating member and provides acting force being substantially radially outward for the anti-rotating member.

Preferably, the anti-rotating device further comprises:

a body, the body coupled to the non-rotating sleeve;

an anti-rotating member base, the anti-rotating member base mounted to the body;

the anti-rotating member is mounted on the anti-rotating member base, the resilient member is mounted on the body, and the resilient member acts on the anti-rotating member base and provides the radially outward force through the anti-rotating member base.

Preferably, the anti-rotating member base is hinged to the body by a first mounting pin; the anti-rotating member is rotatably mounted to the anti-rotating member base by a second mounting pin.

Preferably, the anti-rotating member base includes a sloped surface that acts on the anti-rotating member to provide the radially outward force.

Preferably, the body is provided with a limiting protrusion, and the limiting protrusion is adapted to limit a radial displacement of the anti-rotating member.

Preferably, the anti-rotating device further comprises a third mounting pin, the body coupled to the non-rotating sleeve by the third mounting pin; the anti-rotating device further comprises a radial driving device and an extension disposed on the body, the radial driving device is adapted to drive the body to rotate about the third mounting pin so that the extension can interact with a second non-rotating sleeve.

On the other hand, the invention also discloses a rotary guiding device, which comprises: a first non-rotating sleeve, a second non-rotating sleeve, and the anti-rotating device as described above, the first non-rotating sleeve and the anti-rotating device is connected, and the anti-rotating device is connected to the second non-rotating sleeve.

Preferably, the anti-rotating device is connected with the second non-rotating sleeve as follows: the anti-rotating device has an extension, the extension and the second non-rotating sleeve have overlapping portions in the axial direction.

Through the anti-rotating device of non-rotating sleeve and the rotary guiding device proposed by the invention, on the one hand, the non-rotating sleeve can be prevented from rotating too fast without increasing the overall size of the drilling tool assembly, so that the speed of the non-rotating sleeve is as low as possible, or the non-rotating sleeve does not rotate, and this can provide a basis for accurate attitude measurement and steering control. On the other hand, the two non-rotating sleeve-based guiding devices proposed by the present application can realize preventing the rotation of two non-rotating sleeves too fast by using only one anti-rotating device. And at the same time, the anti-rotating device can also provide a guiding driving force based on a very small structural size.

BRIEF DESCRIPTION OF THE DRAWINGS

The drawings described herein are intended to provide a further understanding of the invention, and are intended to be a part of this invention. The schematic embodiments of this invention and their descriptions are used to interpret this invention and do not constitute an undue limitation of this invention. In the drawing.

In the Figures.

Figure 1:
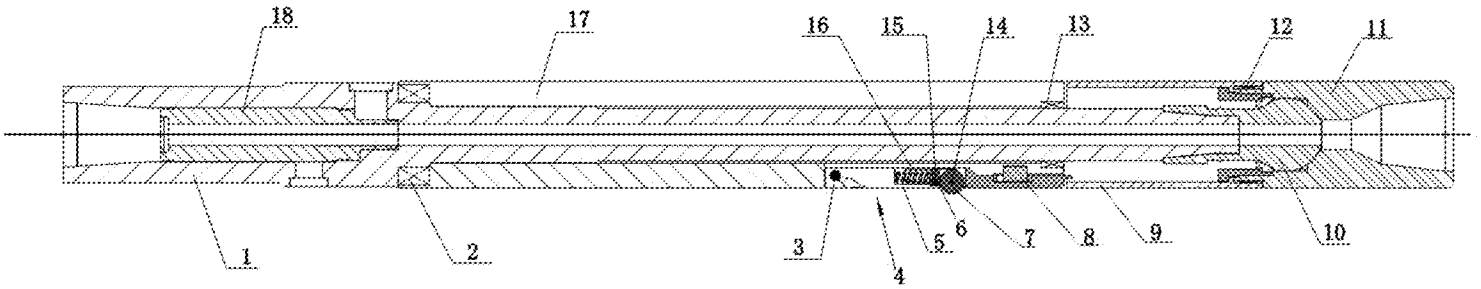
FIG. 1 is a schematic view showing the structure of a drill tool assembly including the anti-rotating device of the present invention.

Upper drive shaft 1, first anti-rotating bearing 2, third mounting pin 3, anti-rotating device 4, top-loading spring 5, anti-rotating member base 6, anti-rotating member 7, limiting protrusion P, radial driving member 8, second non-rotating sleeve 9, universal joint 10, lower drive shaft 11, second anti-rotating bearing 12, extension 13, second mounting pin 14, first mounting pin 15, spring seat 16, first non-rotating sleeve 17, circuit cavity 18, body 19.

DETAILED DESCRIPTION

In order to explain the overall concept of the present invention more clearly, the following detailed description is illustrated by way of example with reference to the attached drawings. It should be noted that, in this context, relational terms such as "first" and "second" are used to distinguish one entity or operation from another entity or operation, and it is not necessary to require or imply that there is such an actual relationship or order between these entities or operations.

Furthermore, the terms "including", "comprising" or any other similar description is intended to cover a non-exclusive contain, which leads to a series of processes, methods, objects, or equipment not only include the elements listed in the context, but also include other elements which is not listed in the context, or the inherent elements of the processes, methods, objects, or equipment. In the absence of further restrictions, elements defined by the statement "including one" are not excluded from the inclusion, but is include other identical elements.

The device disclosed herein relates to application scenarios for oilfield drilling or other exploration drilling. Other system components associated with rotary guiding device, such as derrick systems, powertrains, and signaling systems, are not described extensively here.

As shown in FIG. 1, a drill tool assembly used for drilling has two non-rotating sleeves, and the guiding drive of the tool head can be achieved by the force transmission between the two non-rotating sleeves. Specifically, the drill tool assembly includes an upper drive shaft 1, and the front end of the upper drive shaft 1 is connected to a drive system. The upper drive shaft 1 is usually provided with a circuit cavity 18 for storing some circuit components, and the rear end of the upper drive shaft 1 is installed an first non-rotating sleeve 17, the first non-rotating sleeve 17 is mounted on the upper drive shaft 1 by a first anti-rotating bearing 2, the upper drive shaft 1 is drivingly coupled to a lower drive shaft 11 via a universal joint 10, through which the upper drive shaft 1 transmits axial pressure and circumferential torque for drilling to the lower drive shaft 11. In this embodiment, the drill tool assembly further includes a second non-rotating sleeve 9, the second non-rotating sleeve 9 is mounted on the lower drive shaft 11 by a second anti-rotating bearing 12, In the process of the upper drive shaft 1 driving the tool head, the first non-rotating sleeve 17 and the second non-rotating sleeve 9 inevitably rotate at a lower speed than the upper driving shaft 1 without the anti-rotation effect. One object of the present embodiment is to obstruct the rotation of the first non-rotating sleeve 17 and the second non-rotating sleeve 9 without increasing the overall structural size of the drill tool assembly, thereby reducing the measurement difficulty of the measurement system, especially for the measurement difficulty of the attitude measurement system of the first non-rotating sleeve 17 and the second non-rotating sleeve 9, so as to improve the measurement accuracy and provide guarantee for the accurate control of the control system.

Figure 2:
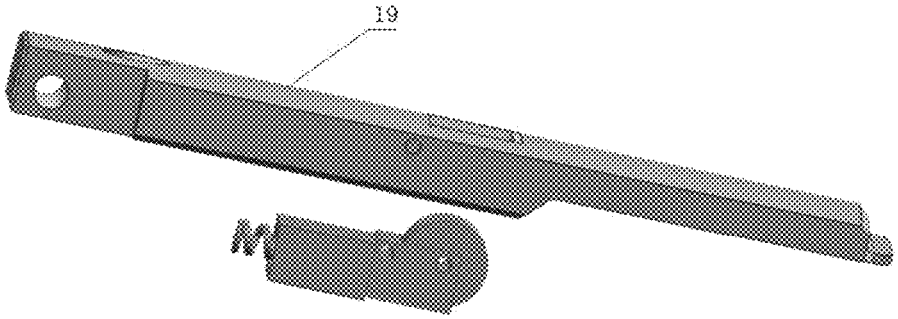
FIG. 2 is a schematic view showing a partial explosion of the anti-rotating device of the present invention.

The anti-rotating device according to the present embodiment will be described in detail below by way of example with reference to FIG. 2 and FIG. 3. FIG. 2 shows a partial explosion of the anti-rotating device of the present invention, which can visually see the overall structure and working principle of the anti-rotating device. In this embodiment, the anti-rotating device comprises a substantially circular anti-rotating member and a substantially strip-shaped body portion, the anti-rotating member is movably mounted on the body, and the anti-rotating member can maintain a tendency to protrude outward in the radial direction of the body under the action of the spring. When the anti-rotating member protrudes from the body, the anti-rotating member can contact the well wall, and under the action of the spring, the anti-rotating member can maintain the contact state with a certain force, and certainly, the reaction of the well wall will also cause the anti-rotating component to have a tendency to retract the body, and the balance between the two trends is maintained by the action of the spring. The anti-rotating member may be in the form of a sheet as a whole, and the well wall can block the rotation of the anti-rotating member when the anti-rotating member abuts against the well wall.

For a more detailed understanding of the working principle of the present embodiment, reference is made to FIG. 3 below. FIG. 3 exemplarily shows an implementation manner of the present application, and those skilled in the art should understand that the implementation manner should not be used as a specific limitation of the scope of protection of the claims in this application.

Figure 3:
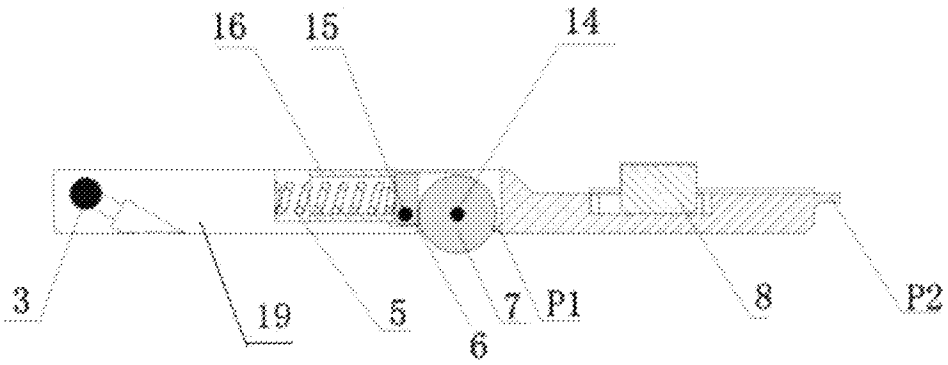
FIG. 3 is a schematic structural view of the anti-rotating device of the present invention.

The anti-rotating device 4 shown in FIG. 3 comprises the body 19 which is generally strip-shaped, the left end of the body 19 is provided with a pin hole, the anti-rotating device 4 is integrally connected to the first non-rotating sleeve 17 through a mounting pin 3 mounted in the pin hole. A fixing screw (not shown) for fixing the body to the mounting pin 3 is also provided on the body. Corresponding pin hole is provided in the first non-rotating sleeve 17 to accommodate the mounting pin 3, and the mounting pin 3 is rotatable within the pin hole of the first non-rotating sleeve 17. The anti-rotating device 4 comprises a top-loading spring 5, the top-loading spring 5 is mounted on the body substantially along the axial direction of the drive shaft by means of the spring seat 16, this way of mounting ensures that the anti-rotating device 4 does not increase the radial dimension of the structure.

The anti-rotating device 4 further includes the anti-rotating member 7 which has a substantially disk shape, and the anti-rotating member 7 is mounted on the anti-rotating member base 6 by a second mounting pin 14.

The anti-rotating member base 6 is provided with a pin hole, and the anti-rotating member base 6 is rotatably mounted on the body by a first mounting pin 15 mounted in the pin hole, the left side of the top-loading spring 5 abuts against the side wall of the body, and the right side acts on the side wall of the anti-rotating member base 6. Due to the action of the top-loading spring 5, anti-rotating member base 6 on which the anti-rotating member 7 is mounted tends to rotate about the first mounting pin 15, so that the anti-rotating member 7 projects outwardly and contacts the well wall. The substantially disk-shaped anti-rotating member 7 is mounted on the anti-rotating member base 6 via a second mounting pin 14, therefore, the axial force acting on the anti-rotating member 7 during the drilling process is not excessively transmitted to the anti-rotating device and the drive shaft. The radial force acting on the anti-rotating member 7 causes a tendency for the anti-rotating member 7 and the anti-rotating member base 6 to compress the top-loading spring 5 inwardly. The greater the elastic force of the top-loading spring 5, the greater the force acting on the shaft wall of the anti-rotating member 7, the smaller the elastic force, and the smaller the force acting on the well wall. Correspondingly, the greater the force of the anti-rotating member 7 in contact with the well wall, the greater the resistance of the well wall to the circumferential rotation of the anti-rotating member 7, and the better the anti-rotating effect of the anti-rotating device for the non-rotating sleeve. however, if the force of the anti-rotating member 7 and the well wall is too large, the rigidity of the anti-rotating device may be too large, and it may be damaged under the long-term action of the well wall, and an appropriate resilient member may be selected according to the type of the formation. Certainly, the top-loading spring used in the embodiment is used as a resilient member, and those skilled in the art can understand that the use of other types of resilient members, such as a disc spring, a leaf spring, etc., can also achieve the corresponding technical effects. It will also be appreciated by those skilled in the art that, in the concept of the present invention, there are many alternatives to the mounting of the anti-rotating member 7 within the anti-rotating device 4.

Figure 4:
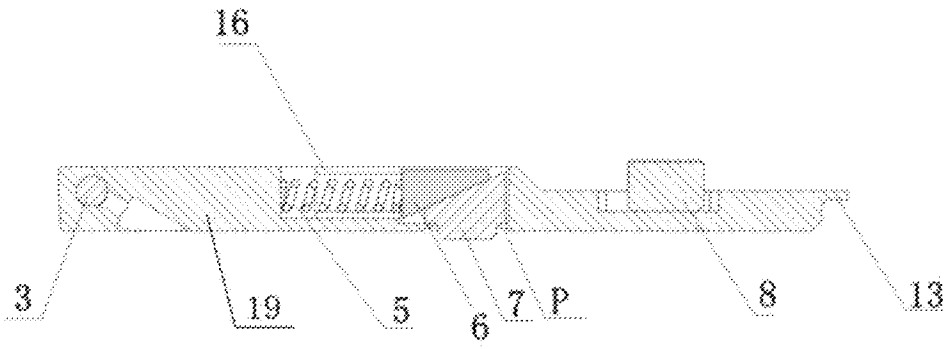
FIG. 4 is another schematic structural view of the anti-rotating device of the present invention.

FIG. 4 discloses another anti-rotating device structure that is generally similar to the structure shown in FIG. 3, the difference is that the driving of the anti-rotating member 7 is driven by the top-loading spring 5 through the wedge-shaped anti-rotating member base 6 in cooperation with the inclined surface of the anti-rotating member 7, Correspondingly, the effect of the well wall on the anti-rotating element 7 also compresses the top-loading spring 5 via the wedge-shaped anti-rotating member base 6.

In combination with FIG. 1 and FIG. 3 below, in some cases, the drill tool assembly may have two non-rotating sleeves, by applying a guiding force from the first non-rotating sleeve to the second non-rotating sleeve, the direction of the second non-rotating sleeve is changed, and then the direction of the lower drive shaft and the tool head is changed, and the rotary guidance of the drill tool assembly is realized. Another technical problem to be solved by the present embodiment is how to prevent the rotation of the two non-rotating sleeves in a compact structure, and it is desirable to solve the driving problem of the rotary guidance at the same time.

To this end, the inventors have made further improvements to the anti-rotating device and the drilling tool assembly. Specifically, the anti-rotating device is mounted on the first non-rotating sleeve 17 at one end by the mounting pin 3, and the other end of the anti-rotating device is freely movable relative to the first non-rotating sleeve 17, thereby forming a swing structure with the mounting pin 3 as a fulcrum. It is particularly important for the technical problem to be further solved that the anti-rotating device of the present embodiment further includes a radial driving member 8, which may be, for example, a hydraulic cylinder or a motor-driven plunger. The radial driving member 8 is mounted between the body of the anti-rotating device and the upper drive shaft. As shown in the figure, a recess for accommodating the radial driving member 8 is provided on the body of the anti-rotating device, and the radial driving member 8 is capable of driving the anti-rotating device to swing about the mounting pin 3. An extension 13 is disposed at the end of the body of the anti-rotating device adjacent to the second non-rotating sleeve 9, the extension is at least partially coincident with the second non-rotating sleeve 9 in a radial direction, thereby, the extension can abut against the inner wall of the second non-rotating sleeve 9 when the radial driving member 8 pushes the anti-rotating device as a whole to swing outward.

Figure 5:
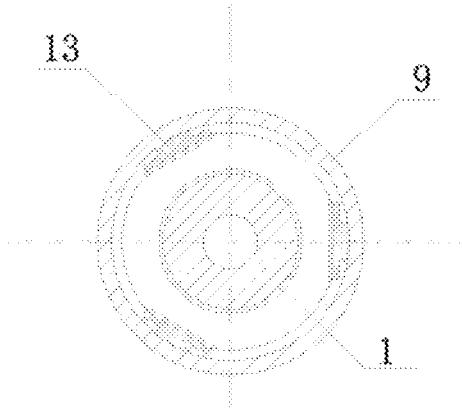
FIG. 5 is a schematic cross-sectional view of the anti-rotating device of the present invention at the extension.
Figure 6A:
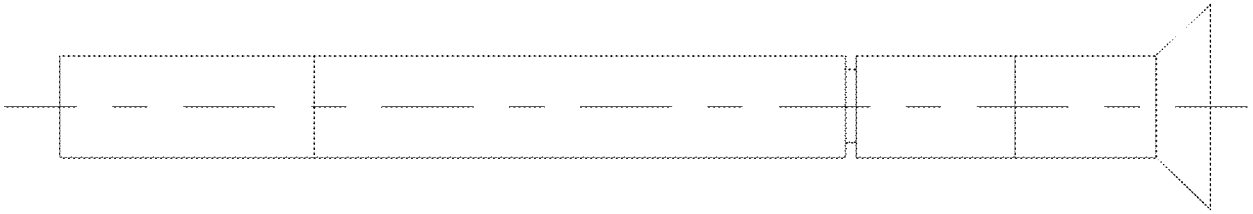
FIG. 6*a* is a schematic view of the anti-rotating device of the present invention in a neutral mode.
Figure 6B:
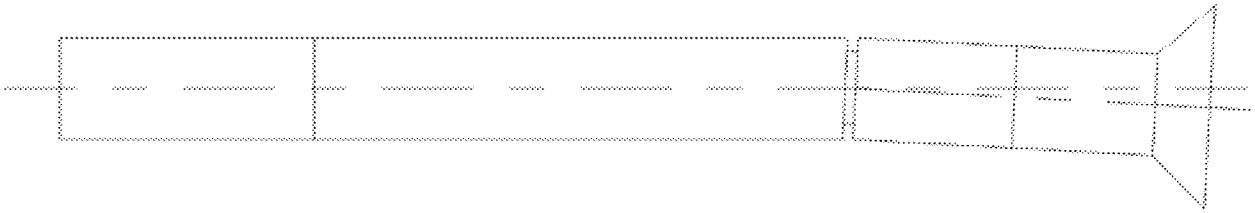
FIG. 6*b* is a schematic view of the anti-rotating device of the present invention in a guiding mode.

A further detailed explanation combined with FIG. 5, FIG. 6*a* and FIG. 6*b* will be described below, in general, the anti-rotating device of the present embodiment may have three or four, and the three or four anti-rotating devices are evenly distributed in the circumferential direction. In the embodiment shown in FIG. 5, the invention has three evenly distributed anti-rotating devices. According to different needs, the anti-rotating device of the present embodiment has at least two optional working modes. As shown in FIG. 6, In the neutral mode, the radial driving members of the three anti-rotating to devices respectively apply the same force outwards, so that the respective extensions 13 abut against the inner wall of the second non-rotating sleeve 9 with the same force. The force of each radial driving member 8 is the same, so that the resultant force of the plurality of anti-rotating devices uniformly acting on the second non-rotating sleeve 9 through the extending 13 is zero, and the direction of the second non-rotating sleeve 9 is not changed. And because the extension 3 abuts against the inner wall of the second non-rotating sleeve 9 with a certain force, during the anti-rotating device realizes the anti-rotating process of the first non-rotating sleeve 17, the second non-rotating sleeve 9 that is abutted together can also be prevented from rotating. As shown in FIG. 6*b*, in the guideing driving mode, the respective radial driving members evenly distributed on the three or four anti-rotating devices can output different forces, the resultant force of the outputs of all the radial driving members becomes the force for changing the direction of the second non-rotating sleeve 9, that is, the guiding driving force, when the direction of the second non-rotating sleeve 9 is changed, the direction of the lower drive shaft 11 connected to the upper drive shaft 1 through the universal joint 10 is also changed, and eventually, the direction of the tool head is changed.

In another aspect, the invention also discloses a rotary guiding device based on the non-rotating sleeve, which comprises: a first non-rotating sleeve 17, a second non-rotating sleeve 9, and the anti-rotating device 4 as described above, the first non-rotating sleeve 17 and the anti-rotating device 4 is connected, and the anti-rotating device 4 is connected to the second non-rotating sleeve 9.

The anti-rotating device 4 is connected with the second non-rotating sleeve 9 as follows: the anti-rotating device has an extension, the extension and the second non-rotating sleeve have overlapping portions in the axial direction. The anti-rotation device 4 and the second non-rotating sleeve 9 have overlapping portions in the axial direction. The overlapping portion can be an axial extension 13 on the anti-rotation device 4, the axial extension 13 extending into the interior of the second non-rotating sleeve 9.

The various embodiments in the specification are described in a progressive manner, and the same or similar parts between the various embodiments can be referred to each other, and each embodiment focuses on differences from the other embodiments. Particularlly, for the system embodiment, since it is basically similar to the method embodiment, the description is relatively simple, and the relevant parts can be referred to the description of the method embodiment.

The above description is only the embodiment of the present application and is not intended to limit the application. Various changes and modifications can be made to the present application by those skilled in the art. Any modifications, equivalents, improvements, etc. made within the spirit and scope of the present application are intended to be included within the scope of the claims.

The invention claimed is:

1. An anti-rotating device of non-rotating sleeve, the anti-rotating device is connected with the non-rotating sleeve in such way so that the anti-rotating device can transmit circumferential acting force to the non-rotating sleeve, thus the non-rotating sleeve are prevented from rotating, wherein the anti-rotating device comprises an anti-rotating member and a resilient member, the anti-rotating member can move in a generally radial direction of the non-rotating sleeve, and the resilient member acts on the anti-rotating member and provides acting force being substantially radially outward for the anti-rotating member; the anti-rotating device further comprises a mounting pin, the anti-rotating device comprises a body, the body coupled to the non-rotating sleeve by the mounting pin; the anti-rotating device further comprises a radial driving device and an extension disposed on the body, the radial driving device is adapted to drive the body to rotate about the mounting pin so that the extension can interact with a second non-rotating sleeve.

2. The anti-rotating device of claim 1, wherein further comprising:

an anti-rotating member base, the anti-rotating member base mounted to the body;

the anti-rotating member is mounted on the anti-rotating member base, the resilient member is mounted on the body, and the resilient member acts on the anti-rotating member base and provides the radially outward force through the anti-rotating member base.

3. The anti-rotating device of claim 2, wherein the anti-rotating member base is hinged to the body by a second mounting pin; the anti-rotating member is rotatably mounted to the anti-rotating member base by a third mounting pin.

4. The anti-rotating device of claim 2, wherein the anti-rotating member base includes a sloped surface that acts on the anti-rotating member to provide the radially outward force.

5. The anti-rotating device of claim 2, wherein the body is provided with a limiting protrusion, and the limiting protrusion is adapted to limit a radial displacement of the anti-rotating member.

6. A rotary guiding device, wherein comprising: a first non-rotating sleeve, a second non-rotating sleeve, and the anti-rotating device as claimed in claim 1, the first non-rotating sleeve and the anti-rotating device are connected, and the anti-rotating device is connected to the second non-rotating sleeve.

7. The rotary guiding device of claim 6, wherein the anti-rotating device is connected with the second non-rotating sleeve as follows: the extension and the second non-rotating sleeve have overlapping portions in the axial direction.

8. A rotary guiding device, wherein comprising: a first non-rotating sleeve, a second non-rotating sleeve, and the anti-rotating device as claimed in claim 2, the first non-rotating sleeve and the anti-rotating device are connected, and the anti-rotating device is connected to the second non-rotating sleeve.

9. A rotary guiding device, wherein comprising: a first non-rotating sleeve, a second non-rotating sleeve, and the anti-rotating device as claimed in claim 3, the first non-rotating sleeve and the anti-rotating device are connected, and the anti-rotating device is connected to the second non-rotating sleeve.

10. A rotary guiding device, wherein comprising: a first non-rotating sleeve, a second non-rotating sleeve, and the anti-rotating device as claimed in claim 4, the first non-rotating sleeve and the anti-rotating device are connected, and the anti-rotating device is connected to the second non-rotating sleeve.

11. A rotary guiding device, wherein comprising: a first non-rotating sleeve, a second non-rotating sleeve, and the anti-rotating device as claimed in claim 5, the first non-rotating sleeve and the anti-rotating device are connected, and the anti-rotating device is connected to the second non-rotating sleeve.

* * * * *